US005988232A

United States Patent [19]

Koch et al.

[11] Patent Number: 5,988,232

[45] Date of Patent: Nov. 23, 1999

[54] VAPOR RECOVERY SYSTEM EMPLOYING OXYGEN DETECTION

[75] Inventors: Wolfgang H. Koch, Batavia; Arthur R. Brown, Warrenville, both of Ill.

[73] Assignee: Tokheim Corporation, Fort Wayne, Ind.

[21] Appl. No.: 09/134,020

[22] Filed: Aug. 14, 1998

[51] Int. Cl.[6] ..... B65B 1/04

[52] U.S. Cl. ..... 141/59; 141/83

[58] Field of Search ..... 141/5, 7, 59, 83, 141/94, 290; 73/23.2

[56] References Cited

U.S. PATENT DOCUMENTS 4,237,722 12/1980 Achari .
4,664,886 5/1987 Novack et al. .
4,883,643 11/1989 Nishio et al. .
5,209,275 5/1993 Akiba et al. .
5,325,896 7/1994 Koch et al. .
5,355,915 10/1994 Payne .
5,395,507 3/1995 Aston et al. .
5,417,256 5/1995 Hartsell, Jr. et al. .
5,498,487 3/1996 Ruka et al. .
5,507,325 4/1996 Finlayson .
5,522,980 6/1996 Hobbs et al. .
5,570,672 11/1996 Kunimitsu et al. .
5,832,967 11/1998 Andersson ..... 141/59

*Primary Examiner*—Steven O. Douglas
*Attorney, Agent, or Firm*—Randall J. Knuth

[57] ABSTRACT

A vapor recovery system is disclosed that provides direct measurements of the oxygen concentration within fugitive vapor emissions displaced from a fuel tank during refueling activity. The hydrocarbon concentration is derived from the oxygen concentration and used to adjust the operating speed of a vapor pump so as to minimize the presence of oxygen in the vapor recovery line.

19 Claims, 2 Drawing Sheets

VAPOR RECOVERY SYSTEM EMPLOYING OXYGEN DETECTION

BACKGROUND OF THE INVENTION

1. Field of the Invention

The present invention relates to vapor recovery systems used in connection with fuel dispensing apparatus, and, more particularly, to a method and system for monitoring the recovered vapor emissions and adjusting the flow rate of pumped vapors to eliminate excess collection of air.

2. Description of the Related Art

The evaporative properties of liquid fuel creates a vapor condition within vehicle fuel tanks in which a volume of volatilized fuel overlies the volume of liquid fuel. During the course of refueling the vehicle, the gasoline flowing into the fuel tank will displace the existing fuel vapor and cause environmentally hazardous vapors to be forced out of the tank and into the atmosphere unless precautionary measures are followed to collect and dispose of the discharged vapors. Rising public awareness of the adverse environmental and health consequences of vapor pollutants has prompted governmental authorities to require that fuel dispensing systems be designed to eliminate the release of vapors into the atmosphere by collecting the vapors for storage and possible recycling. These concerns have led to the development of various systems designed to collect and return the fugitive vapor emissions to a storage tank, which typically corresponds to the on-site underground facility located at the service station where the fuel supply is maintained. The recovered vapors may be further transported to a processing site where the vapors are returned to liquid form in a recycling operation or otherwise disposed of by appropriate means.

One class of conventional vapor recovery systems utilizes a vacuum pump to assist in the collection of fuel vapors and their subsequent transfer to a storage tank. The vacuum pump draws fugitive vapors into an intake line that conveys the collected vapors back to the storage tank. The aspirating action generated by the vacuum pump is normally sufficient to capture the vapor emissions, thereby obviating the need for any sealing element such as a bellows member that is otherwise used to surround the nozzle and seal the vapor recovery passageway to the filler neck of the tank. The inlet port of the vapor intake line need only be disposed in close proximity to the filler neck of the fuel tank from where the vapors emanate.

It is critically important in all such vacuum-assist vapor recovery systems that the volume of gaseous mixtures drawn in through the vapor recovery vacuum inlet closely approximate the volume of vapor being displaced by the gasoline flowing into the fuel tank. If the volume of vapor being collected is less than that being displaced, the non-recovered portion will dissipate into the atmosphere. Conversely, if the volume of vapor being collected is greater than the volume being discharged from the tank, the excess volume will consist of atmospheric air that is recovered along with the vapors. Both conditions are to be avoided. Several configuration have been proposed that focus upon making calculated adjustments to the flow rate generated by the vapor pump based upon measurements produced by sensing apparatus that monitor the fueling and vapor recovery operations.

U.S. Pat. No. 5,355,915 to Payne discloses a vapor recovery fuel dispenser including a vapor pump driven by an electric motor. Sensors are provided to generate pulse train signals representative of the flow rate of the liquid fuel pump and the vapor pump. A controller is provided to control the speed of the vapor pump based upon a comparison of the flow rates of the liquid fuel pump and vapor pump, as indicated by their respective pulse train signals. The controller also monitors whether the liquid pump is operating, whether the vapor pump motor is operating, and the electrical current to the vapor pump motor. Appropriate action is taken by the controller to disable the vapor pump when the parameters being monitored indicate a disabling or error condition.

U.S. Pat. No. 5,417,256 to Hartsell et al. discloses a fuel dispensing system including a vapor pump that provides a vacuum suction along a main vapor recovery path. The system further includes a branch conduit coupled to the main vapor path to provide a branch vapor recovery path, and an adjustable vapor flow valve integrated into the branch conduit and having an adjustable opening, that varies the impedance of the vapor recovery path. A fuel sensor is provided to generate a signal representative of the flow rate of the fuel being dispensed, while a vapor flow sensor supplies a signal indicative of the actual vapor flow rate. A controller is responsive to the flow rate signal for the dispensed fuel and generates a control signal to adjust the vapor flow valve so that the actual vapor flow rate is equalized to a required or desired vapor flow rate calculated on the basis of the liquid fuel flow rate and a ratio-based comparison between the temperatures of the liquid fuel and the atmosphere.

U.S. Pat. No. 5,040,577 to Pope discloses a fuel delivery system comprising a vapor recovery assembly including a recovery pump that draws fugitive vapor emissions through a recovery tube in accordance with a controllable volumetric flow rate. A microprocessor is provided to control the recovery pump so that is withdraws vapor at a flow rate equal to the volumetric flow rate of the fuel delivery pump that regulates the dispensing of fuel. Further adjustments to the vapor flow rate may be made in response to data provided by pressure sensors indicating the hydraulic pressure at the inlet side of the pump.

U.S. Pat. No. 5,269,353 to Nanaji et al. discloses an apparatus for pumping recovered vapor in a vapor recovery liquid fuel dispenser having a vapor passage used to retrieve fuel vapors. The apparatus includes a vapor pump operative to induce vapors to enter and move along the vapor passage and through a vapor pump inlet to a vapor pump outlet. The vapor pump is characterized by a flow rate correlated to a specified operating speed that is inversely proportional to the pressure differential existing between the vapor pump inlet and outlet. Sensors are provided to generate signals representative of these vapor pump pressures. A transducer generates a liquid fuel flow signal indicative of the flow rate for the fuel being dispensed. Electronic circuitry is provided to derive the vapor pump flow rate from the pressure differential and then implement the appropriate adjustments to the operating speed of the vapor pump so that the vapor pump flow rate is equalized with the liquid fuel flow rate.

The above systems are almost exclusively concerned with adjusting the vapor flow rate on the basis of measurements that are neither directly probative nor specifically indicative of the hydrocarbon concentration of the recovered vapors. Any needed adjustments are instead made in response to direct measurements of the volumetric flow rates of the liquid fuel being dispensed and the withdrawn vapors, which measurements are then used to determine the specific change that is required in the vapor pump operating speed in order to match the vapor flow rate to the liquid fuel rate. The overall purpose of tracking the vapor flow rate to the liquid fuel rate is to ensure that the volumetric quantity of retrieved vapor is the same as the volumetric quantity of vapor being displaced by the dispensed fuel. However, the only true measure of performance is based upon whether and to what extent excess air is being prevented from being pumped into the vapor recovery line along with the vapor emissions. Measured against this performance standard, the accuracy of the above systems is not verifiable, and is potentially inexact, since no measurements are obtained of the retrieved vapor to determine its hydrocarbon or air content.

U.S. Pat. No. 5,507,325 to Finlayson discloses a vapor recovery system for fuel dispensers that incorporates a measurement of a vapor-to-air ratio in its control apparatus regulating the vapor retrieval process. Vapors displaced from the tank are collected through a vapor intake and pumped by a variable rate vacuum pump into a vapor storage tank. A flow meter produces a signal representative of the liquid fuel flow rate. An array of vapor-to-air ratio sensors are provided to produce signals representative of the vapor-to-air ratio as measured at a variety of locations that are proximate to the tank opening. The sensors used by the Finlayson reference operate specifically to detect the physical presence of fuel vapors in the sensing environment. A controller is provided to determine a base collection rate (based on the liquid fuel flow rate) at which to operate the vapor pump, which base pump rate is then adjusted according to the signals generated by the vapor-to-air ratio sensors in order to minimize the amount of fuel vapor that escapes into the atmosphere and to minimize the amount of air contained in the gaseous mixture that is drawn along the vapor intake line.

The vapor recovery system of Finlayson is an advance over the systems described above because it provides a means by which the compositional content of the recovered emissions (i.e., vapor versus air) can be directly measured. This permits a more accurate evaluation of whether the vapor pump is inducing the proper volumetric flow of fugitive emissions into the recovery line. However, there are problems attending the Finlayson system which stem from the fact that the sensors are specifically designed to detect the presence of fuel components. Vapor condensation within the intake line is a recurring problem that results when differentials in temperature and pressure within the vapor recovery system reach threshold conditions. The accumulation or even transient deposition of condensed fuel vapors on fuel-detecting sensors will produce false readings of the fuel content in the monitored environment and lead to improper adjustment of the vapor pump rate. Additionally, since only fuel components are being directly detected, any determination of the air content, which alone provides the truest measure of the efficiency of the vapor recovery process, is based on a calculation and not an actual physical reading.

What is therefore needed in the art is a system that monitors the fugitive vapor emissions displaced from a tank during refueling and that adjusts the vapor recovery rate based on direct measurements of the concentration of air in the monitored environment, from which a hydrocarbon concentration can be derived and used to appropriately vary the operating speed of the vapor pump.

SUMMARY OF THE INVENTION

The present invention provides a vapor recovery system that monitors the recovered vapor emissions and generates detection data indicating the oxygen concentration in the vapor stream. This measurement is then used as the basis for deriving the hydrocarbon concentration. The operating speed of the vapor pump is adjusted according to the derived hydrocarbon concentration.

The invention comprises, in one form thereof, a vapor recovery system, operatively associated with a fuel dispensing means having a nozzle for delivering fuel into a receiving tank through the nozzle, comprising a vapor collection means, a sensor means, and a controller means. The vapor collection means, which is disposed proximate to the nozzle of the fuel dispensing means, variably collects vapors from the receiving tank. The sensor means, which is disposed proximate to the nozzle of the fuel dispensing means, senses an oxygen concentration in the vapors from the receiving tank. The controller means, which is operatively connected to the vapor collection means and is responsive to the oxygen concentration sensed by the sensor means, controls the rate of vapor collection by the vapor collection means as a function of the sensed oxygen concentration.

The controller means includes a fuel concentration means, responsive to the oxygen concentration sensed by the sensor means, for determining a hydrocarbon concentration in the vapors from the receiving tank, as derived from the sensed oxygen concentration. The controller means further includes a vapor rate determining means, responsive to the hydrocarbon concentration determined by the fuel concentration means, for generating a control signal applied to the vapor collection means and representative of a vapor collection rate that is effective in minimizing the presence of oxygen in vapors collected by the vapor collection means.

The vapor collection means comprises vapor intake means, integrally associated with the fuel dispensing means and having a vapor input port disposed proximate to a terminal portion of the nozzle and further having a vapor output port, for providing a vapor passageway between the vapor input port and the vapor output port. The vapor collection means further comprises a controllable vapor pump means, coupled to the vapor intake means, for controllably generating a variable vacuum action within the vapor intake means that is effective in drawing vapors into the vapor passageway through the vapor input port.

The invention comprises, in another form thereof, a system for fueling a receiving tank, comprising fuel dispensing means, vapor collection means, sensor means, and control means. The fuel dispensing means, which is operative to withdraw fuel from a supply reservoir and has a nozzle, dispenses fuel through the nozzle into an inlet of the receiving tank. The vapor collection means, which is disposed proximate to the nozzle of the fuel dispensing means, collects vapors from the receiving tank at an adjustable flow rate. The sensor means, which is disposed proximate to the nozzle of the fuel dispensing means, senses an oxygen concentration in the vapors from the receiving tank. The control means, which is operatively coupled to the vapor collection means and is responsive to the oxygen concentration sensed by the sensor means, adjusts the flow rate of the vapor collection means in accordance with the sensed oxygen concentration.

The control means includes a fuel derivation means for deriving a hydrocarbon concentration in the vapors collected by the vapor collection means on the basis of the sensed oxygen concentration, and a vapor rate adjustment means for adjusting the flow rate of the vapor collection means in accordance with the derived hydrocarbon concentration. The flow rate adjustment provided by the vapor rate adjustment means is operative to reduce the presence of oxygen in the collected vapors.

The vapor collection means includes a vapor pump means for controllably generating a variable vacuum action that is effective in drawing vapors into a vapor passageway.

The invention comprises, in yet another form thereof, a method of recovering vapors from a fuel storage tank, comprising the steps of collecting the vapors under the influence of a controllable pumping action generating an adjustable vapor flow rate; sensing an oxygen concentration in the vapors; and controlling the pumping action to adjust the vapor flow rate in accordance with the sensed oxygen concentration.

The step of controlling the pumping action includes the steps of deriving a hydrocarbon concentration in the vapors on the basis of the sensed oxygen concentration; and adjusting the vapor flow rate as a function of the derived hydrocarbon concentration to minimize the presence of oxygen in the collected vapors.

The step of vapor collection includes the step of providing a vapor pump operative to suction vapors according to a controllable operating speed.

The invention comprises, in yet another form thereof, a method of fueling a tank, comprising the steps of dispensing fuel into the tank; drawing vapors from the tank according to an adjustable flow rate; sensing an oxygen concentration in the vapors from the tank; and adjusting the flow rate for drawing vapors from the tank as a function of the sensed oxygen concentration.

The step of flow rate adjustment includes the steps of deriving a hydrocarbon concentration in the vapors on the basis of the sensed oxygen concentration; and adjusting the flow rate as a function of the derived hydrocarbon concentration to minimize the presence of oxygen in the drawn vapors.

The step of drawing vapors from the tank includes the step of providing a vapor pump operative to suction vapors according to a controllable operating speed.

An advantage of the present invention is that by measuring hydrocarbon indirectly through the measurement of available oxygen, instead of measuring hydrocarbon directly within the vapor recovery line, a more improved, stable measurement is provided.

Another advantage of the present invention is that the disclosed system reduces interactions between assisted vapor recovery systems and vehicle on-board fueling recovery (ORVR) systems.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
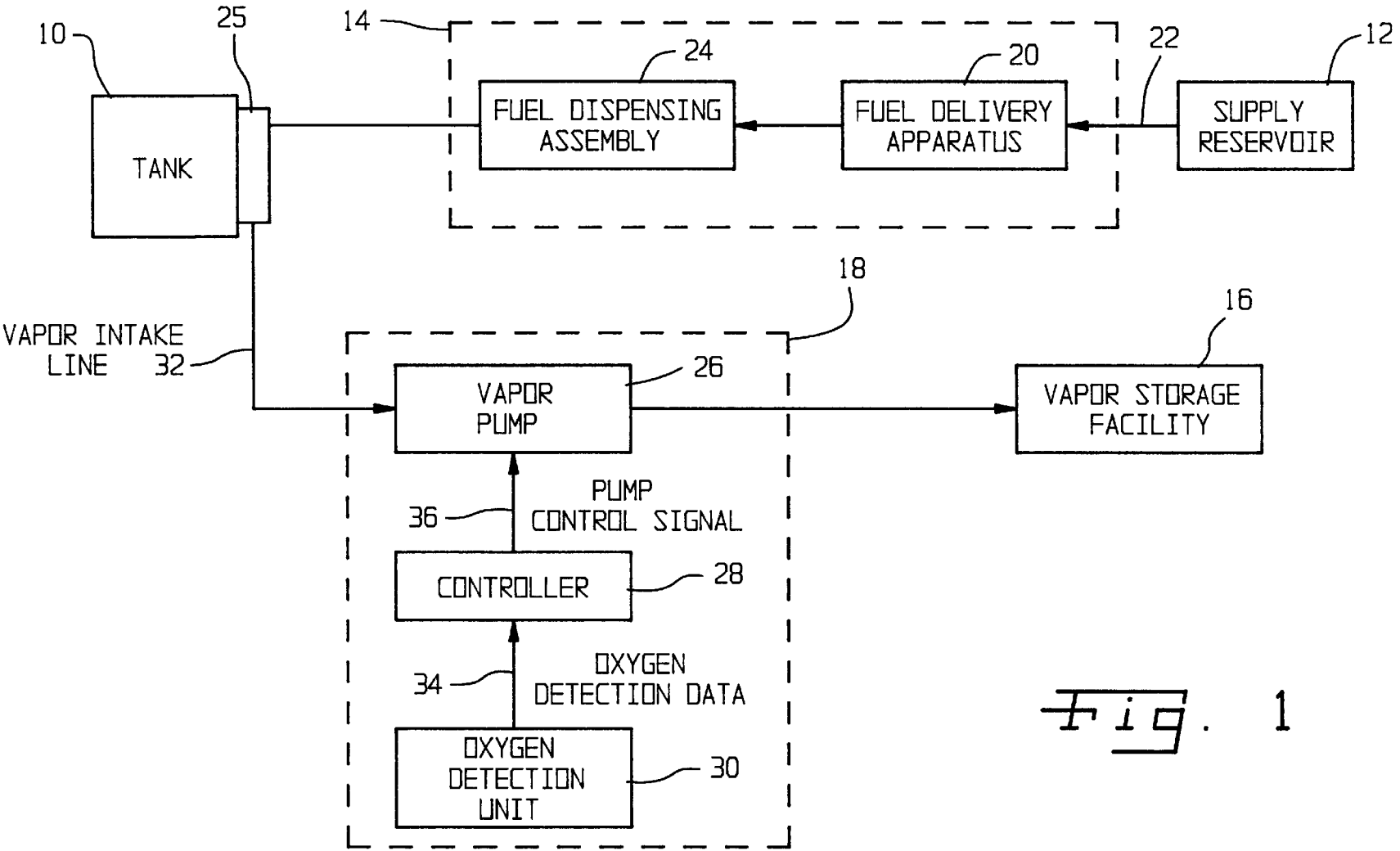
FIG. 1 is a block diagram illustration of a vapor recovery system according to the present invention.

FIG. 1 illustrates, in block diagram form, a system for fueling a tank 10 with liquid fuel from a supply reservoir 12 using fuel delivery system 14 and for collecting and transferring fugitive vapor emissions from tank 10 to a vapor storage facility 16 using a vapor recovery system 18 according to the present invention. The illustrated system is particularly applicable to consumer-activated fueling operations. Accordingly, in these applications, tank 10 corresponds to the fuel tank of a vehicle and the supply reservoir 12 corresponds to the fuel storage chamber typically located in an underground area on the property of a service station. It is standard in the industry for the recovered vapors to be routed back to supply reservoir 12, obviating the need for any separately constructed vapor storage facility 16.

The fuel delivery system 14 includes a fuel delivery apparatus 20 coupled to supply reservoir 12 and operative to pump liquid fuel from supply reservoir 12 along fuel line 22. System 14 further includes a fuel dispensing assembly 24 coupled to fuel delivery apparatus 20 and adapted to be engageable with an opening of tank 10 for dispensing the pumped liquid fuel into tank 10. In automotive applications, the fuel dispensing assembly 24 will preferably be configured in the form of a nozzle member 25 having a dispensing portion that is insertable, at least in part, into a filler neck defining the refueling inlet passageway of tank 10. The fuel delivery system 14 is well known to those skilled in the art and is generally representative of any arrangement capable of delivering fuel to tank 10.

The interior of tank 10 will generally consist of a quantity of liquid fuel, with the remaining volume being occupied by volatilized fuel vapors. The process of dispensing liquid fuel into tank 10 causes a certain volume of the volatilized fuel vapors to be thereby displaced and forced out of tank 10 through its refueling orifice. The vapor recovery system 18 of the present invention is designed to capture these displaced fugitive vapor emissions while minimizing the collection of atmospheric air.

The illustrated vapor recovery system 18 includes a vapor pump 26, a controller 28, and an oxygen detection unit 30. In brief, system 18 operates so that vapor emissions displaced from tank 10 are collected under the influence of a vacuum action generated by vapor pump 26, producing a volumetric vapor flow whose rate is regulated by controller 28 in response to the oxygen concentration level present in the vapor emissions detected by oxygen detection unit 30.

Vapor pump 26 is coupled to a vapor passageway represented by vapor intake line 32, which is disposed in a sufficiently proximate relationship relative to the opening of tank 10 so that substantially all of the displaced vapors can be recovered through vapor intake line 32. The vapor passageway may be formed as an annular conduit concentrically disposed around the liquid fuel line that transports fuel to tank 10, and preferably extends from supply reservoir 12 to a termination point at or near the nozzle aperture where the fuel emerges. It should be apparent to those skilled in the art that any type of vapor intake arrangement may be adapted for use in conjunction with the present invention, including, for example, a vapor pipe traversing the interior of the fueling hose.

The vapor pump 26 creates a vacuum or aspirating action that induces vapor emissions proximate the inlet port of vapor intake line 32 to be drawn into line 32 and transported to vapor storage facility 16. The aspirating action induced by vapor pump 26 generates a volumetric flow within vapor intake line 32 that is regulated by the operating speed of vapor pump 26. This operating speed is adjustably controlled by a control signal generated by controller 28.

Accordingly, vapor pump 26 produces a volumetric vapor stream within vapor intake line 32 that is characterized by a controllably variable flow rate.

The oxygen detection unit 30 monitors the emissions environment proximate the opening of tank 10 and generates signals 34 indicating the concentration level of oxygen in the monitored environment. Depending upon the number of desired monitoring sites, the oxygen detection unit 30 may be comprised of a single or plural ones of individual oxygen sensor elements. Each oxygen sensor provides a direct measurement of the oxygen concentration in the monitored environment. Any type of suitable oxygen sensor known to those skilled in the art may be used. For example, one type of detection unit is the Figaro GS oxygen sensor, which generates an electrical current flowing between terminal electrodes that is proportional to the oxygen concentration in the gas mixture to be measured. The change in output voltage across a resistor through which the current flows is representative of the oxygen concentration.

One characteristic of the vapor environment is that the presence of fuel hydrocarbons reduces the available amount of oxygen in a given air sample, thereby suggesting a mechanism by which the hydrocarbon concentration can be determined from the oxygen measurements. In particular, the direct measurement of oxygen concentration as provided by the oxygen sensor is a sufficient basis from which the hydrocarbon concentration can be derived. This indirect measurement is a reliable indicator of the hydrocarbon concentration since it is known that variations in the hydrocarbon concentration will directly influence the oxygen concentration. Ascertaining and then evaluating these concentration levels constitute an important aspect of the entire methodology for optimally regulating the flow rate generated by vapor pump 26. As discussed below, interpretation of the oxygen concentration data is carried out by controller 28, which initiates whatever action is indicated to adjust the operating speed of vapor pump 26.

Controller 28 receives as input signals the detection data 34 from oxygen detection unit 30, which data represents the measured oxygen concentration level in the sampled environment, and controls the rate of operation of vapor pump 26 in accordance with a hydrocarbon concentration derived from the oxygen concentration. More specifically, controller 28 is provided with a processor unit that derives the hydrocarbon concentration from the oxygen concentration data and then determines the appropriate flow rate that should be generated by vapor pump 26, using the derived hydrocarbon concentration level as the basis for determining the flow rate. This flow rate determination is predicated on a performance objective aimed at minimizing the presence of oxygen in the collected vapor stream. The vapor flow rate should in general exhibit a direct relationship to the hydrocarbon concentration level. For example, at low concentration levels of hydrocarbon, a reduced flow rate is indicated in order to eliminate or at least minimize the recovery of excess oxygen. It may even be desirable to fully disable vapor pump 26 (i.e., suspend its pumping action) if the hydrocarbon concentration level falls below a non-zero threshold value deemed to represent an operational baseline. In sum, controller 28 determines what adjustment should be made to the operating speed of vapor pump 26 to effect the required change in induced flow rate. A signal generator is provided by controller 28 to convert the pump speed adjustment data into a pump control signal 36 representative of the required flow rate and suitable for varying the operating speed of vapor pump 26.

Vapor pump 26 is responsive to the pump control signal 36 provided by controller 28 and adjusts its operating speed, and hence the induced vapor flow rate, in accordance with the pump control signal 36. The vapor pump flow rate will in general be subject to reduction or termination with increasing levels of detected oxygen concentration, which indicate a declining concentration of hydrocarbon. Conversely, at low oxygen concentration levels indicating a hydrocarbon-rich environment, it may be appropriate to increase the flow rate to ensure that no hydrocarbon emissions are escaping into the ambient environment. The vapor recovery system 18 is able to protect against excessive increases in the flow rate because any increase beyond the particular pump operating speed at which the entire volume of displaced vapors is being recovered will be detected by the oxygen sensors as an increase in measured oxygen concentration, which will automatically prompt controller 28 into reducing the operating speed of vapor pump 26. This process continues until the optimal flow rate is reached corresponding to a minimal presence of oxygen in the monitored vapors.

The individual oxygen sensors of oxygen detection unit 30 may be disposed at various detection sites. For example, in order to obtain a measure of the oxygen concentration within the tank, oxygen sensors may be mounted on any portion of the nozzle 25 that becomes disposed within the interior of tank 10 when the nozzle 25 engages the tank opening to dispense fuel. Additionally, oxygen sensors may be positioned within vapor intake line 32 in order to detect the oxygen concentration of the recovered vapors. An array of oxygen sensors located at various detection sites is capable of generating a position-based oxygen concentration profile that can be used by controller 28 to provide highly precise regulation of vapor pump 26. The oxygen sensors may be shielded with demister pads or other suitable protective material to render the sensors immune to the presence of vapor condensate in the recovery line. The oxygen sensors are adapted to transmit their detection measurements over a communications link to controller 28, which along with vapor pump 26 are preferably located within the station kiosk that is servicing the customer. It is preferable for the entire arrangement of oxygen sensors to be integrated with the fuel delivery system 14, as opposed to the impracticable approach of retrofitting fuel tanks with oxygen sensors.

Controller 28 may be any suitable device or component for implementing the indicated control functions. For example, controller 28 may be an analog control circuit or a programmable digital microprocessor as known to those skilled in the art. The necessary interconnections and interfacing between and among the subsystems of vapor recovery system 18 are conventional arrangements known to those skilled in the art. The vapor recovery system 18 preferably operates on a continuous basis for the duration of any refueling activity. This operational mode will feature a continuous supply of oxygen concentration signals to controller 28 from the array of oxygen sensors and automatic adjustment of the operating speed of vapor pump 26 based on the derived hydrocarbon concentration. The flow rate generated by vapor pump 26 is thereby continuously regulated to minimize the presence of atmospheric air in the collected vapors.

Figure 2:
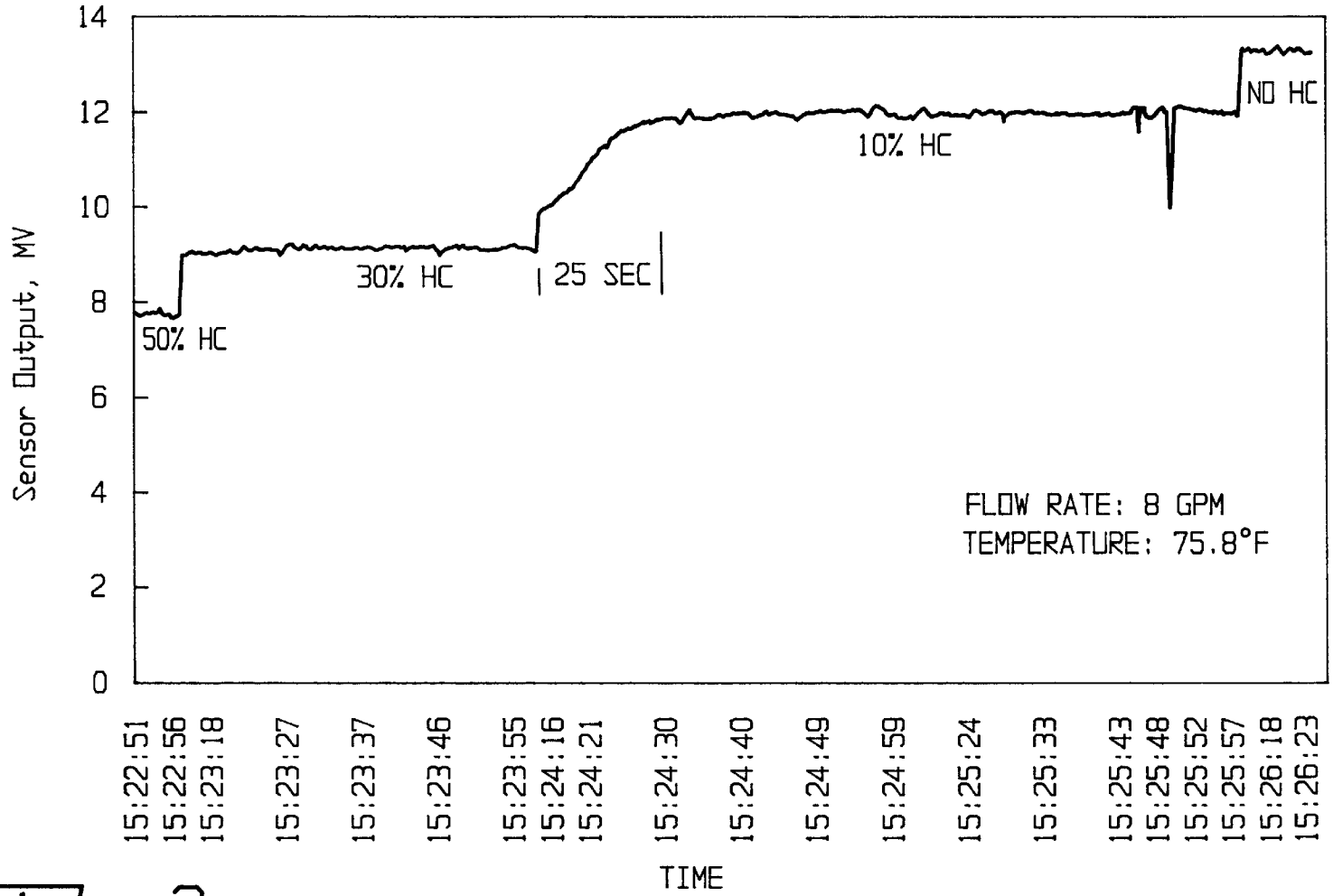
FIG. 2 is a graph illustrating a representative temporal response profile indicating a time-correlated oxygen concentration that is measured by the oxygen detection unit employed in the vapor recovery system of FIG. 1.

FIG. 2 is a graph showing the oxygen sensor output voltage versus time to illustrate the change in detected oxygen concentration in response to variations in hydrocarbon concentration.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A vapor recovery system, operatively associated with a fuel dispensing means having a nozzle for delivering fuel into a receiving tank through said nozzle, comprising:

vapor collection means, adapted to be disposed proximate to the nozzle of said fuel dispensing means, for variably collecting vapors from said receiving tank;

sensor means, adapted to be disposed proximate to the nozzle of said fuel dispensing means, for sensing an oxygen concentration in the vapors from said receiving tank; and controller means, operatively connected to said vapor collection means and responsive to the oxygen concentration sensed by said sensor means, for controlling the rate of vapor collection by said vapor collection means as a function of said sensed oxygen concentration.

2. The vapor recovery system as recited in claim 1, wherein said controller means includes:

fuel concentration means, responsive to the oxygen concentration sensed by said sensor means, for determining a hydrocarbon concentration in the vapors from said receiving tank, as derived from said sensed oxygen concentration; and vapor rate determining means, responsive to the hydrocarbon concentration determined by said fuel concentration means, for generating a control signal applied to said vapor collection means and representative of a vapor collection rate effective in minimizing the presence of oxygen in vapors collected by said vapor collection means.

3. The vapor recovery system as recited in claim 1, wherein said vapor collection means comprises:

vapor intake means, integrally associated with said fuel dispensing means and having a vapor input port disposed proximate to a terminal portion of said nozzle and further having a vapor output port, for providing a vapor passageway between said vapor input port and said vapor output port; and controllable vapor pump means, coupled to said vapor intake means, for controllably generating a variable vacuum action within said vapor intake means that is effective in drawing vapors into said vapor passageway through said vapor input port.

4. The vapor recovery system as recited in claim 3, wherein said controller means includes:

vapor flow rate control means, coupled to said controllable vapor pump means and responsive to the oxygen concentration sensed by said sensor means, for varying the vacuum action of said vapor pump means in accordance with said sensed oxygen concentration.

5. The vapor recovery system as recited in claim 3, wherein said sensor means includes:

an oxygen sensor for sensing the oxygen concentration within said vapor passageway of said vapor intake means.

6. The vapor recovery system as recited in claim 3, wherein said sensor means includes:

an oxygen sensor for sensing the oxygen concentration within an interior space of said receiving tank.

7. The vapor recovery system as recited in claim 6, wherein said oxygen sensor is adapted to be integrally secured to the nozzle of said fuel dispensing means and suitably disposed to be positioned within the receiving tank as the nozzle engages an opening of said receiving tank during fueling operations.

8. The vapor recovery system as recited in claim 3, wherein said sensor means includes:

an oxygen sensor for sensing the oxygen concentration outside an opening of said receiving tank into which fuel is discharged by said fuel dispensing means.

9. The vapor recovery system as recited in claim 8, wherein said oxygen sensor is adapted to be integrally secured to the nozzle of said fuel dispensing means.

10. A system for fueling a receiving tank, comprising:

a nozzle;

fueling dispensing means, operative to withdraw fuel from a supply reservoir and associated with said nozzle, for dispensing fuel through said nozzle into an inlet of said receiving tanks;

vapor collection means, disposed proximate to said nozzle of said fuel dispensing means, for collecting vapors from said receiving tank at an adjustable flow rate;

sensor means, disposed proximate to said nozzle of said fuel dispensing means, for sensing an oxygen concentration in the vapors of said receiving tank; and control means, operatively coupled to said vapor collection means and responsive to the oxygen concentration sensed by said sensor means, for adjusting the flow rate of said vapor collection means in accordance with said sensed oxygen concentration.

11. The fueling system as recited in claim 10, wherein said control means includes:

fuel derivation means for deriving a hydrocarbon concentration in the vapors collected by said vapor collection means on the basis of said sensed oxygen concentration; and vapor rate adjustment means for adjusting the flow rate of said vapor collection means in accordance with said derived hydrocarbon concentration.

12. The fueling system as recited in claim 11, wherein the flow rate adjustment provided by said vapor rate adjustment means is operative to reduce the presence of oxygen in said collected vapors.

13. The fueling system as recited in claim 12, wherein said vapor collection means includes:

vapor pump means for controllably generating a variable vacuum action that is effective in drawing vapors into a vapor passageway.

14. A method of recovering vapors from a fuel storage tank, comprising the steps of:

collecting said vapors under the influence of a controllable pumping action generating an adjustable vapor flow rate;

sensing an oxygen concentration in said vapors; and controlling said pumping action to adjust said vapor flow rate in accordance with said sensed oxygen concentration.

15. The method of recovering vapors as recited in claim 14, wherein the step of controlling said pumping action includes the steps of:

deriving a hydrocarbon concentration in said vapors on the basis of said sensed oxygen concentration; and adjusting said vapor flow rate as a function of said derived hydrocarbon concentration to minimize the presence of oxygen in said collected vapors.

16. The method of recovering vapors as recited in claim 15, wherein the step of vapor collection includes the step of:

providing a vapor pump operative to suction vapors according to a controllable operating speed.

17. A method of fueling a tank, comprising the steps of:

dispensing fuel into said tank;

drawing vapors from said tank according to an adjustable flow rate;

sensing an oxygen concentration in the vapors from said tank; and adjusting the flow rate for drawing vapors from said tank as a function of said sensed oxygen concentration.

18. The fueling method as recited in claim 17, wherein the step of flow rate adjustment includes the steps of:

deriving a hydrocarbon concentration in said vapors on the basis of said sensed oxygen concentration; and adjusting said flow rate as a function of said derived hydrocarbon concentration to minimize the presence of oxygen in said drawn vapors.

19. The fueling method as recited in claim 18, wherein the step of drawing vapors from said tank includes the step of:

providing a vapor pump operative to suction vapors according to a controllable operating speed.

* * * * *